US011358400B2

(12) United States Patent
Asamoto

(10) Patent No.: US 11,358,400 B2
(45) Date of Patent: Jun. 14, 2022

(54) TRANSPORT DEVICE AND RECORDING DEVICE

(71) Applicant: SEIKO EPSON CORPORATION, Tokyo (JP)

(72) Inventor: Katsuya Asamoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/158,486

(22) Filed: Jan. 26, 2021

(65) Prior Publication Data

US 2021/0229469 A1 Jul. 29, 2021

(30) Foreign Application Priority Data

Jan. 29, 2020 (JP) ..... JP2020-012249

(51) Int. Cl.
*B41J 11/00* (2006.01)

(52) U.S. Cl.
CPC ..... *B41J 11/00222* (2021.01); *B41J 11/007* (2013.01)

(58) Field of Classification Search
CPC .... B41J 11/00222; B41J 11/007; B41J 15/04; B41J 11/00242; B41J 11/002; B41J 29/38
See application file for complete search history.

(56) References Cited

U.S. PATENT DOCUMENTS

2006/0192830 A1* 8/2006 Lee ..... B41J 15/046 347/104

FOREIGN PATENT DOCUMENTS

JP 2007-504970 3/2007

* cited by examiner

*Primary Examiner* — Bradley W Thies
(74) *Attorney, Agent, or Firm* — Workman Nydegger

(57) ABSTRACT

A transport device includes a transporting belt, which includes a support face that adhesively supports a medium, and which transports the adhered medium, a heating unit that heats the transporting belt before the medium is supported at the support face, a pressing unit that is provided downstream of the heating unit in a movement direction of the transporting belt and that presses the medium against the support face, a temperature detection unit that detects a temperature of at least a part of the support face, from the heating unit to the pressing unit in the movement direction, and a control unit that controls the heating unit based on a detection result of the temperature detection unit.

6 Claims, 5 Drawing Sheets

TRANSPORT DEVICE AND RECORDING DEVICE

The present application is based on, and claims priority from JP Application Serial Number 2020-012249, filed Jan. 29, 2020, the disclosure of which is hereby incorporated by reference herein in its entirety.

BACKGROUND

1. Technical Field

The present disclosure relates to a transport device and a recording device.

2. Related Art

In related art, a recording device is known that forms an image or the like by ejecting droplets, such as ink, on a medium transported by a transporting belt (JP-T-2007-504970, for example). In JP-T-2007-504970, a multi-function digital printer (a recording device) is disclosed that is provided with an adhesive transporting belt (a transporting belt), a belt heating member (a heating unit) that heats the transporting belt before a print material (a medium) is adhered to the transporting belt, and a roller (a pressing unit) that presses the print material such that the print material is closely adhered to the transporting belt. It is further disclosed that, as a result of pre-heating the transporting belt using the belt heating member, the print material is more easily caused to be closely adhered to the transporting belt when pressing the print material using the roller.

The adhesiveness of the medium with respect to the transporting belt is important in terms of suppressing floating and displacement of the medium with respect to the transporting belt and of improving image quality. The adhesiveness of the medium with respect to the transporting belt depends on a temperature of the transporting belt at the pressing unit. In JP-T-2007-504970, since the temperature of the transporting belt at the pressing unit is not taken into consideration, the adhesiveness of the medium with respect to the transporting belt may become unstable.

SUMMARY

A transport device according to an aspect of the present disclosure includes a transporting belt including a support face that adhesively supports a medium, and configured to transport the adhered medium, a heating unit configured to heat the transporting belt before the medium is supported at the support face, a pressing unit provided downstream of the heating unit in a movement direction of the transporting belt, and configured to press the medium against the support face, a temperature detection unit configured to detect a temperature of at least a part of the support face, from the heating unit to the pressing unit in the movement direction, and a control unit configured to control the heating unit based on a detection result of the temperature detection unit.

A recording device according to an aspect of the present disclosure includes a transporting belt including a support face that adhesively supports a medium, and configured to transport the adhered medium, a recording unit configured to perform recording on the transported medium, a heating unit configured to heat the transporting belt before the medium is supported at the support face, a pressing unit provided downstream of the heating unit in a movement direction of the transporting belt, and configured to press the medium against the support face, a temperature detection unit configured to detect a temperature of at least a part of the support face, from the heating unit to the pressing unit in the movement direction, and a control unit configured to control the heating unit based on a detection result of the temperature detection unit.

DESCRIPTION OF EXEMPLARY EMBODIMENTS

1. Embodiment

First, an overall configuration of a transport device 1 and a printing device 100 according to an embodiment will be described.

The printing device 100 according to the present embodiment is an example of a recording device. The printing device 100 is an inkjet printer that performs printing (textile printing) of a pattern or the like, by ejecting ink onto a medium M that is a fabric or the like.

Note that, in each of the drawings below, to illustrate each of members and the like in a recognizable size, each of the members and the like is illustrated to a scale different from an actual scale. Further, for convenience of description, an X-axis, a Y-axis, and a Z-axis are illustrated as three axes orthogonal to each other. Further, a direction parallel to the X-axis is referred to as an "X direction", a direction parallel to the Y-axis is referred to as a "Y direction", and a direction parallel to the Z-axis is referred to as a "Z direction". Then, a leading end side of each of arrows indicating each of the directions is referred to as a "positive side" and a base end side thereof is referred to as a "negative side". Note that the X direction corresponds to a width direction of the medium M to be described below, and the Y direction corresponds to a transport direction (a horizontal direction) on a transport path of the medium M in a printing unit 30. The Z direction corresponds to a height direction, a vertical direction, and an up-down direction of the printing device 100.

Figure 1:
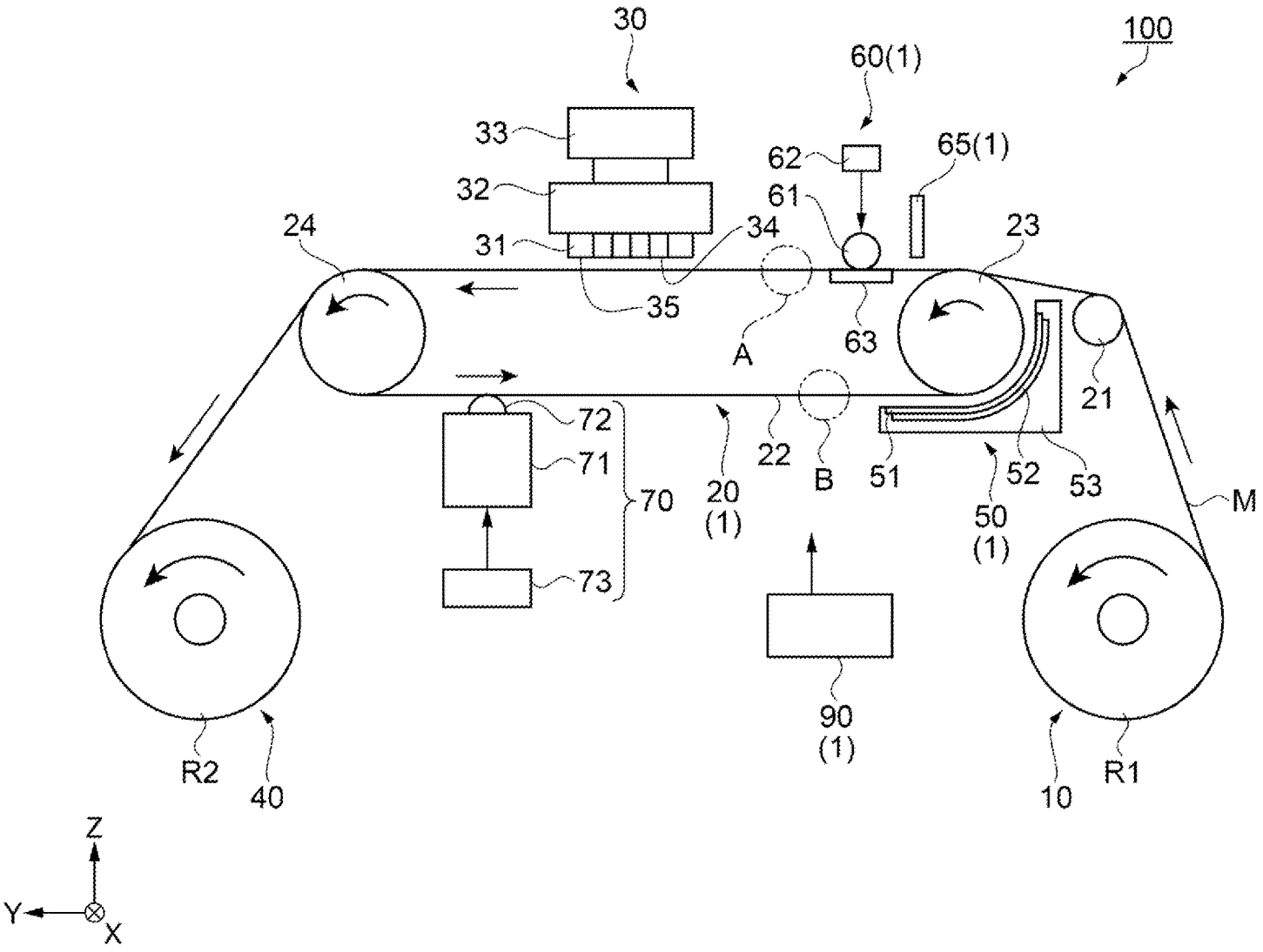
FIG. 1 is a side view schematically illustrating a printing device according to an embodiment.
Figure 4:
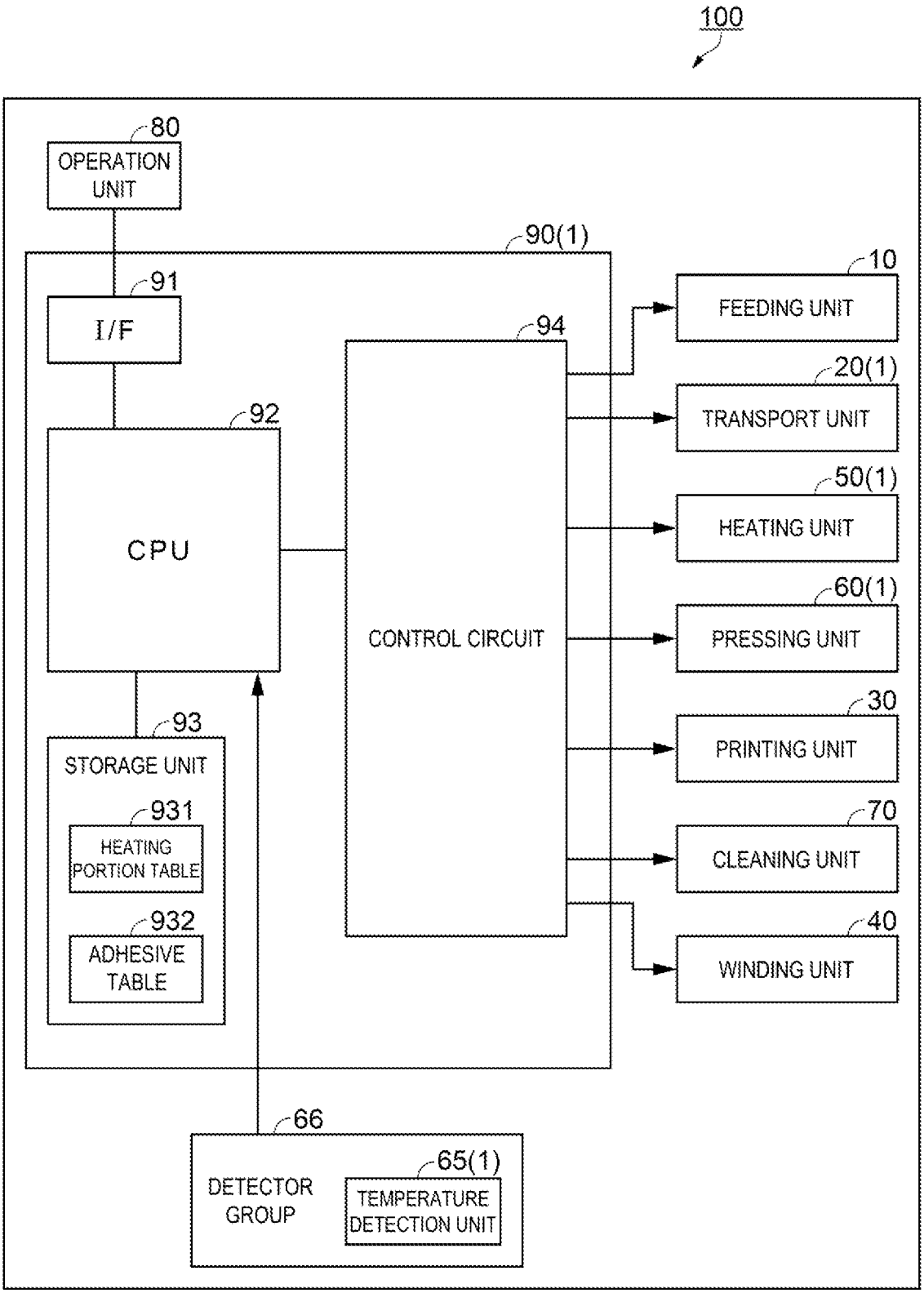
FIG. 4 is a block diagram illustrating an electrical configuration of the printing device.

As illustrated in FIG. 1 and FIG. 4, the transport device 1 is provided with a transport unit 20 that transports the medium M, a heating unit 50 that heats a transporting belt 22 of the transport unit 20, and a pressing unit 60 that presses the medium M against the transporting belt 22. Further, the transport device 1 is provided with a temperature detection unit 65 that detects the temperature of an adhesive layer 25 (see FIG. 2) warmed by the heating unit 50, and a control unit 90 configured that controls the heating unit 50 on the basis of a detection result of the temperature detection unit 65.

Further, as well as including the transport device 1, as illustrated in FIG. 1 and FIG. 4, the printing device 100 is provided with a feeding unit 10 that feeds out the medium M wound in a roll shape, the printing unit 30, which is the recording unit that performs printing on the medium M transported by the transport unit 20, and a winding unit 40 that takes up the printed medium M. Further, the printing device 100 is provided with a cleaning unit 70 that cleans the transporting belt 22 (more precisely, the adhesive layer 25 illustrated in FIG. 2).

The temperature detection unit 65 uses an infrared sensor in the present embodiment. Further, as illustrated in FIG. 1, the temperature detection unit 65 is disposed downstream of the heating unit 50 and upstream of the pressing unit 60. The temperature detection unit 65 detects the temperature of a support face 22*a* of at least a part of the transporting belt 22 from the heating unit 50 to the pressing unit 60, in a movement direction of the transporting belt 22 to be described below. Further, a pair of the temperature detection units 65 are disposed in positions facing the adhesive layer 25 and further to the outside than both of end portions of the medium M in the width direction. In other words, the temperature detection unit 65 is installed in a position that does not interfere with the medium M. In this way, interference between the temperature detection unit 65 and the medium M can be suppressed when setting the medium M on the support face 22*a*. Note that, in the present embodiment, the medium M is a fabric such as cotton, silk, wool, a chemical fiber, a mixed fiber blend, or the like.

As illustrated in FIG. 1, the feeding unit 10 supports a roll body R1 around which the medium M is wound, such that an axial direction of the roll body R1 is the X direction (the width direction) of the printing device 100. By rotating the roll body R1 in one direction (the counterclockwise direction in FIG. 1) using a rotary drive unit (not illustrated), the feeding unit 10 feeds out the medium M toward the transport unit 20. Operations of the rotary drive unit are controlled by the control unit 90.

As illustrated in FIG. 1, the transport unit 20 is configured by a transport roller 21, the transporting belt 22, a rotating roller 23, a driving roller 24, and the like. The transport roller 21 relays the medium M fed from the feeding unit 10 to the transporting belt 22.

The transporting belt 22 is configured by an endless rubber member wound around the rotating roller 23 disposed upstream of the printing unit 30 in the transport direction and around the driving roller 24 disposed downstream of the printing unit 30 in the transport direction. The transporting belt 22 is held in a state in which a predetermined tension acts thereon, such that a region of the transport path (to be described later) between the rotating roller 23 and the driving roller 24 is horizontal.

Figure 2:
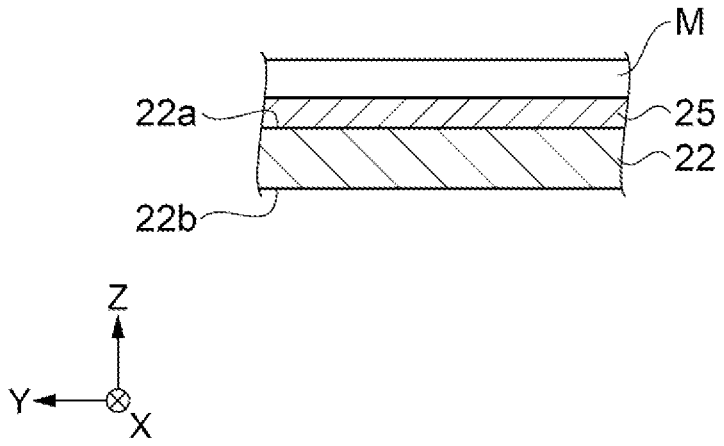
FIG. 2 is an enlarged view of a section A of a transporting belt moving along a transport path.
Figure 3:
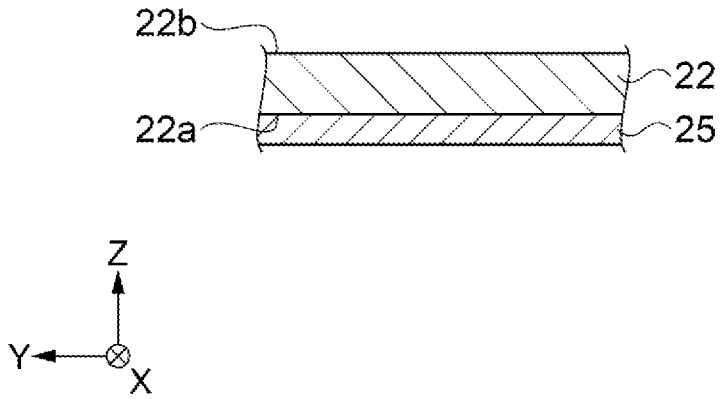
FIG. 3 is an enlarged view of a section B of the transporting belt moving along a transport preparation path.

As illustrated in FIG. 2 and FIG. 3, an outer circumferential surface of the transporting belt 22 is the support face 22*a* that supports the medium M. The support face 22*a* is provided with the adhesive layer 25 to which an adhesive is applied and to which the medium M is adhered.

The transporting belt 22 supports and transports the medium M that is supplied from the transport unit 20, the medium M being pressed against and caused to be in close contact with the adhesive layer 25 by the pressing unit 60 to be described below. The transporting belt 22 is configured as a so-called glue belt in which the adhesive has been applied to the support face 22*a*. In this way, stretchable fabric and the like can be handled as the medium M on which the printing is possible.

As illustrated in FIG. 2 and FIG. 3, the rotating roller 23 and the driving roller 24 support an inner circumferential face 22*b* of the transporting belt 22. The driving roller 24 includes a motor (not illustrated) that drives the driving roller 24 to rotate. When the driving roller 24 is driven to rotate, the transporting belt 22 rotates in accordance with the rotation of the driving roller 24, and the rotating roller 23 is driven to rotate by the rotation of the transporting belt 22.

As a result of the driving of the driving roller 24, the transporting belt 22 is caused to revolve in the counterclockwise direction in FIG. 1, and thus transports the medium M in a state of being supported by the support face 22*a* in the transport direction corresponding to the positive Y direction. Then, the medium M is transported in the transport direction by the transporting belt 22, and an image is formed on the medium M in the printing unit 30 to be described later.

Note that, in the present embodiment, a pathway of the transporting belt 22 revolving in the counterclockwise direction will be referred to as a revolving circuit path below. Then, of the revolving circuit path, the path that transports the medium M will be referred to as the transport path, and apart from that, the path that does not configure the transport path of the medium M will be referred to as a transport preparation path. Thus, the transport path is a path from a position at which the fed out medium M is pressed by the pressing unit 60 and supported by the transporting belt 22 to a position at which the printing is complete and the medium M is peeled from the transporting belt 22. The view illustrated in FIG. 2 illustrates a state of the transporting belt 22 moving along the transfer path. Further, the revolving circuit path apart from the transport path serves as the transport preparation path. FIG. 3 illustrates a state of the transporting belt 22 moving along the transport preparation path.

On the transport path, the support face 22*a* of the revolving transporting belt 22 supports the medium M on a side (a positive Z side) facing the printing unit 30, and transports the medium M from the rotating roller 23 side to the driving roller 24 side. Further, on the transport preparation path, the support face 22*a* of the revolving transporting belt 22 is oriented toward a side (substantially a negative Z side) facing the cleaning unit 70 and the heating unit 50 to be described below, and only the transporting belt 22 provided with the adhesive layer 25 moves from the driving roller 24 side to the rotating roller 23 side.

The winding unit 40 rotates a roll body R2 in one direction (the counterclockwise direction in FIG. 1) using a rotary drive unit (not illustrated), and thus, the medium M on which the image is formed is peeled from the adhesive layer 25 of the transporting belt 22 and wound up in a roll shape. The winding unit 40 supports the roll body R2 around which the medium M is wound, such that a rotating shaft of the roll body R2 is parallel with the width direction (the X direction). Operations of the rotary drive unit are controlled by the control unit 90.

The pressing unit 60 presses the medium M against the adhesive layer 25 formed on the transporting belt 22 and causes the medium M to closely adhere to the adhesive layer 25. In the movement direction (the transport direction) of the transporting belt 22, the pressing unit 60 is provided upstream of the printing unit 30 and downstream of the heating unit 50. The pressing unit 60 is provided with a press roller 61, a press roller driving unit 62, and a roller support unit 63. The movement direction of the transporting belt 22 changes at each of locations of the circumferential surface of the transporting belt 22, and the movement direction of the transporting belt 22 in the vicinity of the printing unit 30 is the positive Y direction. Further, the movement direction of the transporting belt 22 can be expressed as a direction in which the transporting belt 22 is revolving when recording is performed on the medium M by the printing unit 30.

The press roller 61 is formed in a cylindrical shape or a columnar shape, and is provided so as to be able to rotate in a circumferential direction along a cylindrical surface of the press roller 61. The press roller 61 is disposed so as to rotate in a direction along the transport direction, and such that a roller shaft (not illustrated) thereof is parallel to the width direction intersecting the transport direction. The roller support unit 63 is provided on the inner circumferential face 23*b* side of the transporting belt 22, facing the press roller 61 with the transporting belt 22 interposed therebetween.

The length of the press roller 61 in the width direction is the same as the length of the transporting belt 22 in the width direction. Note that the length of the medium M in the width direction is less than the length of the press roller 61 and the length of the transporting belt 22 in the width direction. The length of the roller support unit 63 in the width direction is substantially the same as the length of the press roller 61 in the width direction.

The press roller driving unit 62 presses the press roller 61 in the downward direction (the negative Z direction). The pressed press roller 61 rotates in accordance with the movement of the transporting belt 22 in the transport direction. The medium M superimposed on the transporting belt 22 is pressed while being pressed against the transporting belt 22 between the press roller 61 and the roller support unit 63. As a result of operation of the pressing unit 60, the medium M can be adhered to the adhesive layer 25 formed on the support face 22*a* of the transporting belt 22, and the occurrence of floating of the medium M on the transporting belt 22 can be suppressed.

The printing unit 30 is disposed vertically above (in the positive Z direction with respect to) the transporting belt 22 that moves in the transport direction (the positive Y direction), and performs printing on the medium M supported by the support face 22*a* (the adhesive layer 25) of the transporting belt 22. The printing unit 30 is provided with an ejecting head 31, a carriage 32, a carriage moving unit 33, and the like. The ejecting head 31 discharges ink as droplets on the medium M supported by the transporting belt 22.

The ejecting head 31 is provided with a nozzle plate 35 in which a plurality of nozzle rows 34 are formed. For example, four nozzle rows 34 are formed in the nozzle plate 35, and ink of a different color can be discharged from each of the nozzle rows 34, such as cyan, magenta, yellow, and black, for example. The nozzle plate 35 faces the medium M transported on the transporting belt 22.

The carriage moving unit 33 moves the ejecting head 31 in the width direction of the medium M (the X direction), which is the direction intersecting the transport direction of the medium M. The carriage 32 on which the ejecting head 31 is mounted is supported by a guide rail (not illustrated) disposed along the X direction, and is configured to be able to reciprocate in the X direction by the carriage moving unit 33. A mechanism combining a ball screw and a ball nut, a linear guide mechanism, or the like can be adopted as a mechanism of the carriage moving unit 33.

The carriage moving unit 33 is provided with a motor (not illustrated) as a power source for moving the carriage 32 in the X direction. When the motor is driven under control of the control unit 90, the ejecting head 31 reciprocates in the X direction, together with the carriage 32. Note that the ejecting head 31 according to the present embodiment is mounted on the carriage 32, and is a serial head type in which the ejecting head 31 ejects the ink while moving in the width direction of the medium M (the X direction). Note also that the ejecting head 31 may be a line head type in which a nozzle row is provided across the width direction of the medium M (the X direction) and which ejects the ink without the carriage 32 being moved in the width direction (the X direction).

In the printing in the printing unit 30, the printing is performed by the ejecting head 31 in which, first, the transport by the transporting belt 22 is stopped when the transported medium M has reached a position below the predetermined nozzle row 34 of the ejecting head 31, and the printing by the ejecting head 31 is performed simultaneously with the carriage 32 being moved in the positive X direction (an outward path). Next, the transporting belt 22 moves by a predetermined amount in the transport direction, and stops. Then, the printing is performed by the ejecting head 31 simultaneously with the carriage 32 being moved in the negative X direction (a return path). Next, the transporting belt 22 moves by the predetermined amount in the transport direction, and stops.

As described above, by intermittently moving the transporting belt 22, the printing device 100 performs the printing while intermittently moving the medium M that is closely adhered to the transporting belt 22. In the printing device 100 according to the present embodiment, the control unit 90 performs the printing by causing the transport unit 20 to perform the intermittent movement of the medium M and causing the printing unit 30 to perform the ejection operation of the ink.

The transporting belt 22 moves along the transport path, and, after the printed medium M has been peeled from the transporting belt 22 by the winding unit 40, the transporting belt 22 is turned back by the driving roller 24, and moves along the transport preparation path. Note that, when the printing (the textile printing) of the pattern or the like on the medium M, which is a fabric or the like, is performed along the transport path, ink that has permeated through the medium M, ink that oozes from the ends in the width direction of the medium M, fibers detached from the medium M, and the like become attached to the adhesive layer 25 of the transporting belt 22.

By cleaning the transporting belt 22 using a cleaning liquid, while the transporting belt 22 moves along the transport preparation path, the cleaning unit 70 removes the ink, the fibers, and the like attached to the adhesive layer 25. Specifically, the cleaning unit 70 is disposed below (in the negative Z direction with respect to) the endless transporting belt 22, that is, on the driving roller 24 side, and cleans the support face 22*a* including the adhesive layer 25 of the transporting belt 22, from below.

The cleaning unit 70 is provided with a cleaning tank 71 that stores the cleaning liquid, a cleaning roller 72 that is immersed in the cleaning liquid and that rotatably comes into contact with the transporting belt 22, and a movement mechanism 73 that uses an air cylinder (not illustrated) that moves the cleaning unit 70 in the up-down direction. Further, the cleaning unit 70 is provided with a motor (not illustrated) as a power source for driving the cleaning roller 72 to rotate.

The cleaning roller 72 is configured by a rotating brush having a width that is the same as or slightly greater than the length in the width direction of the transporting belt (the X direction) that is substantially orthogonal to the movement direction of the transporting belt 22 (the Y direction). Further, the cleaning roller 72 includes a cylindrical rotating shaft (not illustrated) that extends in the width direction, and both ends of the rotating shaft are rotatably supported on both of walls including short sides of the cleaning tank 71.

The cleaning unit 70 configured in this manner is moved upward by the movement mechanism unit 73, and comes into contact, from below, with the support face 22*a* of the transporting belt 22 that is moving along the transport preparation path. Then, by rotating the cleaning roller 72 containing the cleaning liquid, the cleaning unit 70 cleans the support face 22*a* including the adhesive layer 25.

As illustrated in FIG. 4, the printing device 100 is provided with an operation unit 80 that performs a setting operation and an input operation to provide commands to the control unit 90. The operation unit 80 is configured by a touch panel type display unit or the like. Note that the operation unit 80 may be provided separately from the printing device 100.

The control unit 90 is a control unit that performs control of the printing device 100. As illustrated in FIG. 4, an interface (I/F) unit 91 performs data transmission and reception between the operation unit 80 and the control unit 90. A CPU 92 is an arithmetic processing device that performs overall control of the printing device 100. A storage unit 93 secures regions for storing programs of the CPU 92, and a working region. The CPU 92 controls each of the units in accordance with a control circuit 94.

Further, in the present embodiment, the storage unit 93 stores a heating portion table 931 and an adhesive table 932 to be described below. Note that a detector group 66 monitors a status inside the printing device 100, and the control unit 90 controls each of components on the basis of a detection result thereof. Note that the above-described temperature detection unit 65 also configures one of the detector group 66.

The heating unit 50 will be described.

The heating unit 50 according to the present embodiment softens and activates the adhesive properties of the adhesive layer 25 by increasing the temperature of the adhesive layer 25 formed on the support face 22*a* of the transporting belt 22 up to a predetermined temperature (65° C., for example), and improves the adhesiveness between the medium M and the adhesive layer 25. The heating unit 50 heats the support face 22*a* including the adhesive layer 25 of the transporting belt 22, from a direction facing the support face 22*a*, before the medium M is supported by the support face 22*a*. Specifically, before the support face 22*a* reaches the pressing unit 60 on the transport preparation path, the heating unit 50 heats the support face 22*a* including the adhesive layer 25, before the transport preparation path is turned back by the rotating roller 23, around a periphery including the rotating roller 23.

The thickness of the adhesive layer 25 according to the present embodiment is approximately several tens μm. Further, the thickness of the transporting belt 22 is approximately 2 mm to 3 mm. Thus, the heating of the adhesive layer 25 also heats the transporting belt 22. In the present embodiment, hereinafter, "heating the adhesive layer 25" may be expressed as "heating the support face 22*a*" or "heating the transporting belt 22".

In other words, the heating unit 50 heats the transporting belt 22 (on the transport preparation path) before the medium M is supported by the support face 22*a*, from a height direction (the direction facing the support face 22*a*) that intersects the movement direction of the transporting belt 22.

Note that in the present embodiment, the endless transporting belt 22 is used, but when a transporting belt that is not endless is used as the transport device, the transporting belt may be heated before the media is supported by the support face, from above (from the height direction) that intersects the movement direction of the transporting belt.

Figure 5:
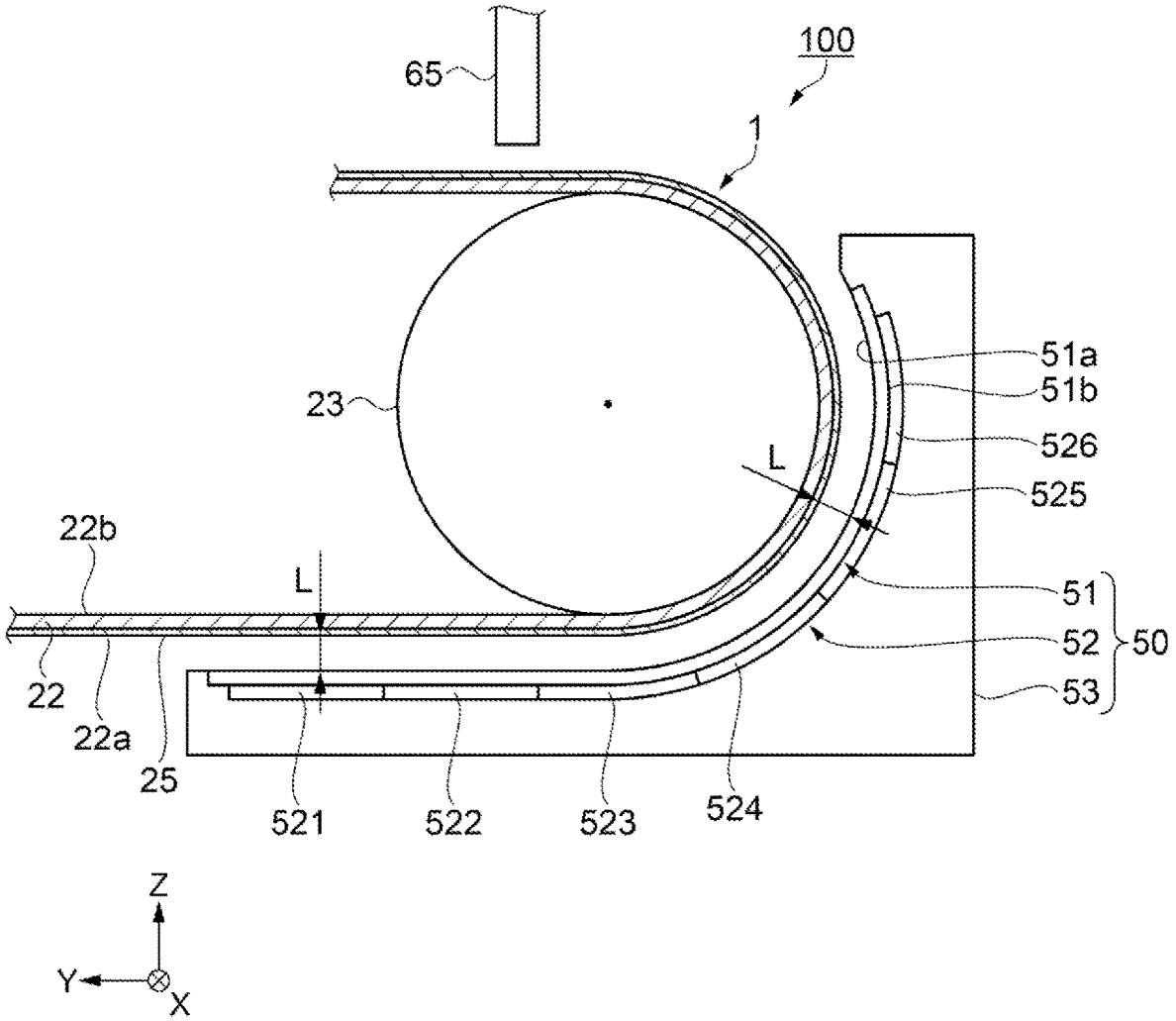
FIG. 5 is a schematic cross-sectional view illustrating a heating unit.

As illustrated in FIG. 5, the heating unit 50 is provided with a radiation plate 51, heating portions 52 affixed to the radiation plate 51, a heating frame 53 that fixes the radiation plate 51 and the heating portion 52, and the like. In the present embodiment, the radiation plate 51 is disposed such that a distance from the support face 22*a* (the adhesive layer 25) of the transporting belt 22 to an inside face 51*a* facing the support face 22*a* is a distance L.

Thus, in a region before reaching the rotating roller 23, the radiation plate 51 is in a state of being substantially parallel to the support face 22*a*, while the distance between the support face 22*a* and the inside face 51*a* is the distance L. Further, in a region in which the radiation plate 51 overlaps with the rotating roller 23, the radiation plate 51 is concentric with the rotating roller 23, and the support face 22*a* and the inside face 51*a* are separated from each other by the distance L.

Further, the radiation plate 51 is configured to extend along the width direction of the transporting belt 22. The length in the width direction of the radiation plate 51 is configured to be slightly longer at both ends thereof with respect to the length in the width direction of the transporting belt 22. In the present embodiment, the radiation plate 51 is formed using an aluminum plate member, of which one side is curved.

The heating portions 52 are adhered to an outside face 51*b* of the radiation plate 51, and heat the radiation plate 51 such that radiant heat is emitted from the radiation plate 51. The heating portions 52 according to the present embodiment are configured by six of the heating portions 52. Specifically, the six heating portions 52 are disposed side by side in the order of a first heating portion 521, a second heating portion 522, a third heating portion 523, a fourth heating portion 524, a fifth heating portion 525, and a sixth heating portion 526, from the upstream of the transport preparation path that is the movement direction of the transporting belt 22.

The heating portions 52 are configured by flat heaters each having the same specification as each other. The flat heater is configured by sandwiching a heating element, such as metal foil, inside a flexible sheet member, such as a synthetic resin, and generates heat such that a temperature distribution is substantially uniform. Each of the heating portions 52 is configured to extend along the width direction of the transporting belt 22 (the X direction). The length in the width direction of the heating portion 52 is configured to be slightly longer at both ends thereof with respect to the length in the width direction of the transporting belt 22.

The heating portions 52 each configured in this manner are adhered over substantially the entire outside face 51*b* of the radiation plate 51 in the above-described order. The heating frame 53 fixes the radiation plate 51 in a state in which the inside face 51*a* of the radiation plate 51 to which the heating portions 52 are attached is exposed.

When power is supplied (conducted) to the metal foil of the flat heater, the metal foil generates heat, and the heat is transferred through the sheet member to the radiation plate 51. The radiation plate 51 warms up as a result of the transfer of heat from the heating portions 52. The warmed-up radiation plate 51 emits radiant heat toward the transporting belt 22 (the support face 22*a*) facing the radiation plate 51. As a result of this operation, the adhesive layer 25 is warmed.

Here, temperature changes of a transporting belt when an adhesive layer is heated by a known heating unit will be described with reference to FIG. 6.

Figure 6:
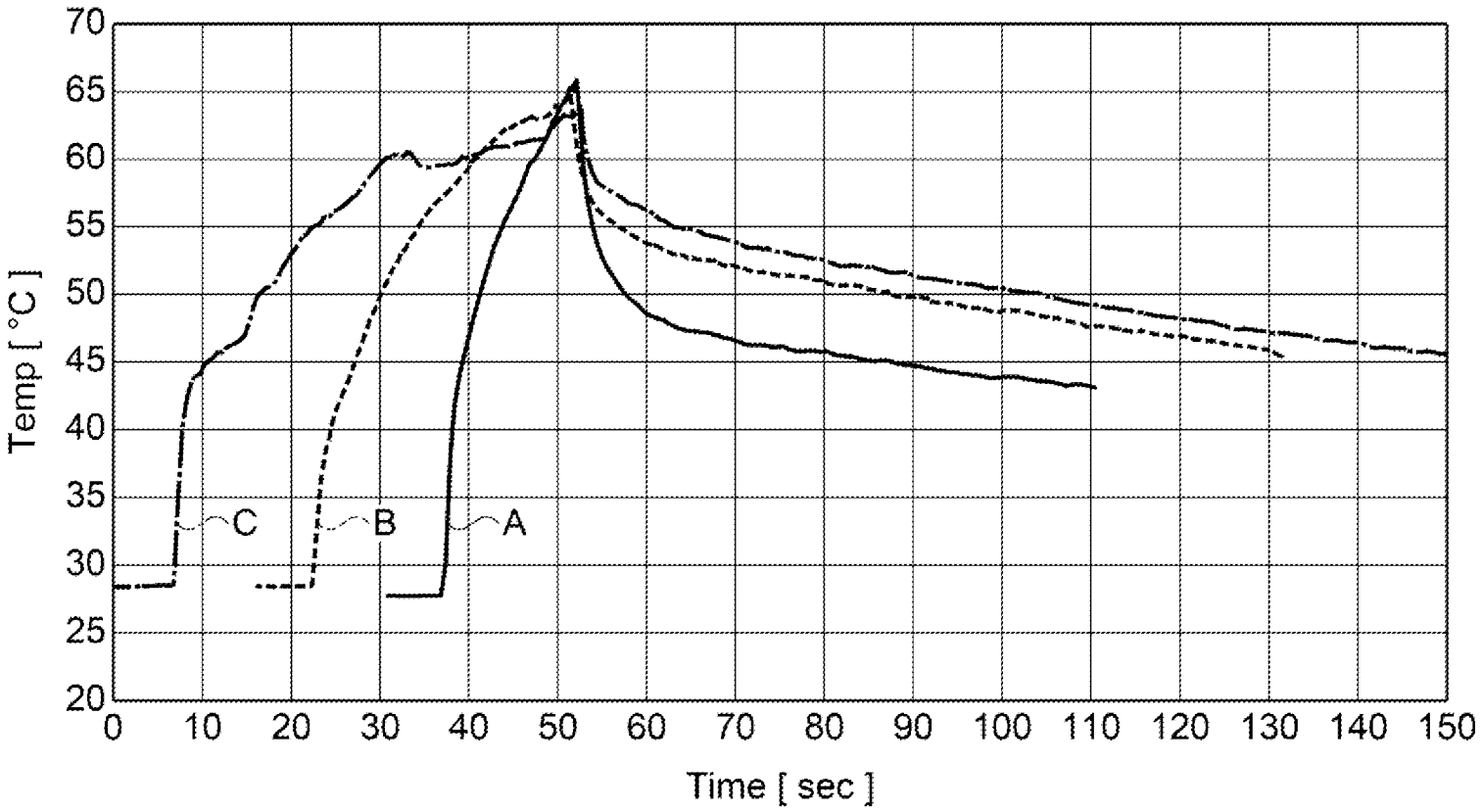
FIG. 6 is a diagram illustrating temperature changes of a transporting belt heated by a heating unit of related art.

FIG. 6 illustrates heating times required until the temperature of the adhesive layer is heated up to 65° C. and heat dissipation states after the temperature reaches 65° C., when a number of printing passes is changed, and the length of the heating portion on the transport preparation path is constant. Note that the horizontal axis indicates an elapsed time, and the vertical axis indicates the temperature of the adhesive layer.

Then, since a period of time over which the transporting belt passes through a length (a range) of the heating portion on the transport preparation path is determined by the number of passes, power energizing the heating portion is changed in accordance with the number of passes, such that the temperature of the adhesive layer when passing through the heating portion is 65° C. In other words, the known heating unit is configured by the single heating portion. Then, since the single heating portion is used, a movement distance of the transporting belt in the heating portion is constant, and the temperature of the heating portion is adjusted by changing the power in accordance with the number of passes.

Specifically, graph A is a graph of a high speed printing mode using two passes, in which the transporting belt passes through the heating portion in 15 seconds. Therefore, the transporting belt reaches 65° C. by being heated in the heating portion for 15 seconds. Graph B is a graph of a medium speed printing mode using four passes, in which the transporting belt passes through the heating portion in 30 seconds. Therefore, the transporting belt reaches 65° C. by being heated in the heating portion for 30 seconds. Graph C is a graph of a slow printing mode using six passes, in which the transporting belt passes through the heating portion in 45 seconds. Therefore, the transporting belt reaches 65° C. by being heated in the heating portion for 45 seconds.

As shown in FIG. 6, in graph A indicating the high speed mode, it can be seen that the temperature of the adhesive layer after the heating is complete drops rapidly in comparison to graph B and graph C. Further, conversely, it can be seen that in graph B indicating the medium speed mode and graph C indicating the low speed mode, the temperature of the adhesive layer after the heating is complete drops more slowly in comparison to graph A.

Note that in the printing device 100, the temperature of the adhesive layer 25 at the pressing unit 60 is, for example, 65° C. in the present embodiment, and the temperature at the printing unit 30 is preferably substantially the air temperature.

These differences in heat dissipation are due to the differences in the way in which the transporting belt is warmed. In the high-speed mode, the support face side of the transporting belt is warmed, and in the medium speed mode or the low speed mode, the transporting belt is warmed to the middle of the transporting belt. In other words, in the medium speed mode and the low speed mode, even if the amount of energizing power is lower than that in the high speed mode, the time for the current conduction is longer, that is, the time over which the transporting belt passes through the heating portion is longer, and thus, an amount of heat accumulated in the transporting belt is larger.

Returning to FIG. 5, in the present embodiment, the control unit 90 performs control to adjust a number of the heating portions 52 to be driven in accordance with the number of printing passes, while an amount of power to be supplied to the heating portions 52 is constant. Specifically, in the present embodiment, the length in the transport direction of each of the heating portions 52 is, for example, 100 mm. Therefore, with the six heating portions 52, the length of the heating portions 52 is 600 mm in total.

Then, when the printing is performed in two passes, of the six heating portions 52, all (six) of the heating portions 52 are used. Therefore, the length of the heating portions 52 that perform the heating is 600 mm. In other words, the movement distance, which is the distance over which the transporting belt 22 is heated by the heating portions 52, is 600 mm. Further, when the printing is performed in four passes, of the six heating portions 52, three of the adjacent heating portions 52 are used. Therefore, the length of the heating portions 52 that perform the heating is 300 mm. In other words, the movement distance, which is the distance over which the transporting belt 22 is heated by the heating portions 52, is 300 mm. Further, when the printing is performed in six passes, of the six heating portions 52, two of the adjacent heating portions 52 are used. Therefore, the length of the heating portions 52 that perform the heating is 200 mm. In other words, the movement distance, which is the distance over which the transporting belt 22 is heated by the heating portions 52, is 200 mm.

In this way, in the present embodiment, when the printing speed is two passes, four passes, or six passes in the printing, the time (a movement time) over which the transporting belt 22 passes through the heating portions 52 that generate the heat is substantially constant at 15 seconds. Note that the printing speed corresponds to a movement speed of the transporting belt 22.

Further, the printing device 100 according to the present embodiment performs the printing while intermittently moving the medium M. Thus, specifically, the movement speed is the speed obtained by dividing the distance that the transporting belt 22 has moved up to when the printing is completed, by a sum of a stop time period over which the movement of the transporting belt 22 is stopped (approximately 2 seconds when two passes are performed, for example) and a movement time period over which the transporting belt 22 moves (approximately 0.2 seconds when the two passes are performed, for example). Note that the stop time period is the time period over which the recording on the medium M is performed by the ejecting head 31. Therefore, the greater the number of passes, the longer the time required for the recording on the medium M, and thus the stop time period increases as the number of passes increases. Thus, the movement speed of the transporting belt 22 in the intermittent transportation changes in accordance with the change in the number of passes. In other words, when the intermittent transportation is employed with the serial head type, the movement speed of the transporting belt 22 can be expressed by the number of passes.

In the present embodiment, the heating portions 52 to be driven are switched in accordance with the number of printing passes. Specifically, the number of the heating portions 52 driven during the printing using two passes is six, that is, from the first heating portion 521 to the sixth heating portion 526. The heating portions 52 driven during the printing using four passes is 3, that is, from the fourth heating portion 524 to the sixth heating portion 526. The heating portions 52 driven during the printing using six passes is 2, that is, the fifth heating portion 525 and the sixth heating portion 526. In other words, the heating units 50 are controlled by the control unit 90 such that the lower the printing speed (the movement speed of the transporting belt 22), the lower the number of heating portions 52 to be driven. This is an example of the heating portion table 931, which will be described later, which shows a correspondence between the printing speed and the number and output of the heating portions 52 corresponding to the printing speed. Note that in addition to the number of the heating portions 52 to be driven, the heating unit 50 may be controlled by the control unit 90 such that the output of the heating portions 52 to be driven decreases as the printing speed (the movement speed of the transporting belt 22) decreases. In other words, the heating unit 50 may be controlled by the control unit 90 such that, as the printing speed (the movement speed of the transporting belt 22) decreases, at least one of the number of heated portions 52 to be driven is decreased or the output of the heating portions 52 is decreased.

As described above, the transporting belt 22 is heated over the same time period by changing the number of the heating portions 52 heating the transporting belt 22, even when the printing speed differs, such as with the two passes, the four passes, or the six passes during the printing. In this way, when the printing speed differs, only the selected heating portions 52 are heated, and the region of the radiation plate 51 in contact with the selected heating portions 52 is warmed. Then, the radiant heat is emitted to the facing adhesive layer 25 from the warmed radiating plate 51.

In the present embodiment, the transporting belt 22 is heated for approximately 15 seconds even when the number of passes differs. The control unit 90 controls the number and the output of the heating portions 52 in accordance with the number of printing passes (the movement speed), and thus, even when the number of printing passes (the movement speed) differs, a total amount of heat applied to the transporting belt 22 including the adhesive layer 25 is constant. Therefore, even if the number of printing passes (the movement speed) differs, with respect to the cooling of the transporting belt 22 after reaching 65° C., a cooling performance can be obtained close to that of graph A illustrated in FIG. 6.

Further, by causing the cooling performance of the transporting belt 22 after reaching 65° C. to be close to that of graph A illustrated in FIG. 6, that is, by causing the amount of heat accumulated in the transporting belt 22 to be relatively small, the amount of heat (the temperature) of the transporting belt 22 when the portion of the transporting belt 22 heated by the heating portions 52 reaches the printing unit 30 is small. Here, the higher the temperature of the portion of the transporting belt 22 heated by the heating portions 52 after passing through the pressing unit 60, the more a temperature gradient increases in the positive Y direction after reaching the printing unit 30. This is because the surroundings of the printing unit 30 are exposed to the atmosphere, and heat is released into the atmosphere each time the transporting belt 22 moves in the positive Y direction. In the present embodiment, the amount of heat (the temperature) of the portion of the transporting belt 22 heated by the heating portions 52 when that portion reaches the printed portion 30 is small, and thus, the temperature gradient of the transporting belt 22 (the support face 22*a*) in the positive Y direction is reduced. In this way, color differences in the positive Y direction of the image recorded on the medium M caused by the temperature gradient can be reduced. As a result, the quality of the image recorded on the medium M can be improved.

Further, in the present embodiment, in accordance with the number of printing passes (the movement speed), from among the six heating portions 52, the control unit 90 selects the heating portions 52 in order from the heating portion 52 closest to the pressing unit 60, and heats the support face 22*a*. Note that, as illustrated in FIG. 5, the heating portion 52 closest to the pressing unit 60 is the sixth heating portion 526, and the heating portion 52 furthest from the pressing unit 60 is the first heating portion 521. In this way, as a result of the control unit 90 selecting the heating portions 52 to be heated in order from the heating portion 52 closest to the pressing unit 60, the distance from the selected heating portion 52 to the pressing unit 60 can be shortened, and heating loss that increases depending on the distance is reduced. In other words, the temperature of the adhesive layer 25 at the pressing unit 60 is brought closer to the target of 65° C. by reducing the heating loss.

Further, in the present embodiment, the temperature of each of the heating portions 52 is specifically set to 200° C. or the like. Therefore, the temperature of the radiation plate 51 is also approximately 200° C. Note that the control unit 90 adjusts the temperature of the heating portion 52 by adjusting the power to the heating portion 52 on the basis of the printing speed and the detected temperature at the temperature detection unit 65. In order to do so, the control unit 90 controls the heating portions 52 using so-called PID control (proportional-integral-differential control) such that the detected temperature becomes the target temperature. In any case, the control unit 90 performs control such that the power to energize each of the heating portions 52 (the first heating portion 521 to the sixth heating portion 526) is the same.

On the basis of the movement speed and the detection result at the temperature detection unit 65, as an input to the heating unit 50 (the heating portions 52), the control unit 90 adjusts the selection of the heating portions 52 to be driven and adjusts the power applied to the heating portions 52 selected from among the plurality of heating portions 52, in order to adjust the temperature of the heating unit 50. Note that, while the power remains constant, a power amount may be adjusted by adjusting a time period of the energization. In other words, the time period of the energization may be controlled by PWM (pulse width modulation).

Note that, as illustrated in FIG. 4, the storage unit 93, and the operation unit 80 that performs the above-described setting operation and the like are installed in the printing device 100. Then, the adhesive table 932, in which a type of the adhesive and the target temperature corresponding to the type of adhesive are associated with each other, is stored in the storage unit 93. Thus, as a result of a user using the operation unit 80 to select the type of adhesive to be used, for example, the control unit 90 reads the target temperature corresponding to the adhesive from the adhesive table 932 and drives the heating portions 52 in order to obtain that temperature.

Further, the storage unit 93 stores the heating portion table 931 in which the printing speed and the number of the heating portions 52 to be driven are associated with each other. Thus, as a result of the user using the operation unit 80 to select the printing mode (the high speed mode, the medium speed mode, the low speed mode), for example, the control unit 90 reads, from the heating portion table 931, the number of the heating portions 52 to be driven corresponding to the printing mode, selects the heating portions 52 to be heated, and drives the heating portions 52. Note that in the heating portion table 931, the printing speed may be associated with the output of the heating portions 52 corresponding to the printing speed. In other words, in the heating portion table 931, the printing speed is associated with at least one of the number and the output of the heating portions 52 corresponding to the printing speed.

2. First Modified Example

In the present embodiment, the heating unit 50 is provided with the six heating portions 52. However, if the temperature detection unit 65 is provided that detects the temperature of the adhesive layer 25 after the heating, the single heating portion 52 may be used. In this case, the control unit 90 may control the heating unit 50 on the basis of the detection result at the temperature detection unit 65.

3. Second Modified Example

In the present embodiment, the heating unit 50 is provided with the six heating portions 52. However, the number of heating portions 52 is not limited to six, as long as a plurality of the heating portions 52 is provided.

4. Third Modified Example

In the present embodiment, the heating unit 50 is provided with the six heating portions 52. However, the heating unit 50 may be provided with a heating portion that is a single flat heater configured by sandwiching a plurality of independent heating elements, such as metal foils or the like inside a sheet member.

5. Fourth Modified Example

In the present embodiment, the heating portions 52 of the heating unit 50 are respectively configured to have the same specification. However, the configuration is not limited thereto, and a configuration may be adopted in which lengths of the heating portions in the direction along the movement direction of the transporting belt 22 are varied.

6. Fifth Modified Example

In the present embodiment, the flat heater is used as the heating portion 52 of the heating unit 50. However, the configuration is not limited thereto, and a configuration may be adopted in which a heater tube housing a heating element contained in a quartz tube is used as the heating portion, and a plurality of the heater tubes are arranged along the movement direction of the transporting belt 22. In other words, the transporting belt 22 need not necessarily be heated via the radiation plate 51. For example, the transporting belt 22 may be heated by at least one air blowing unit (fan) that blows heated air.

7. Sixth Modified Example

Although in the present embodiment, the target temperature for warming the adhesive is described as being 65° C., the target temperature is not limited thereto, and the target temperature may be changed depending on the type of adhesive to be used.

8. Seventh Modified Example

In the present embodiment, as the movement speed of the intermittent transportation, an average speed is used, which is obtained by dividing the distance moved by the transporting belt 22 up to when the printing is completed by the sum of the stop time period and the movement time period, but the movement speed is not limited thereto. For example, the intermittent transportation may not be employed when the line head type is used. In such a case, the movement speed of the transporting belt 22 need not necessarily be expressed by the number of passes, and the movement speed of the transporting belt 22 may be expressed using a circumferential speed of the driving roller 24.

9. Eighth Modified Example

In the present embodiment, as the heating portion table 931, the correspondence relationship between the printing speed (the number of passes) and the number of the heating portions 52 to be driven corresponding to the printing speed is stored in the storage unit 93, but the heating portion table is not limited thereto. When the line head type is used, the circumferential speed of the driving roller 24 can be used as the movement speed of the transporting belt 22, and thus, as the heating portion table 931, a correspondence relationship between the movement speed of the transporting belt 22 and the number of the heating portions 52 to be driven corresponding to the movement speed of the transporting belt 22 may be stored in the storage unit 93.

10. Ninth Modified Example

In the present embodiment, the amount of power supplied to each of the heating portions 52 (the first heating portion 521 to the sixth heating portion 526) is controlled to be the same, but the configuration is not limited thereto. The power supplied to each of the heating portions 52 may be different for each of the heating portions 52.

According to the above-described embodiment and modified examples, the following effects can be obtained.

The transport device 1 according to the present embodiment is provided with the transporting belt 22, the heating unit 50, the pressing unit 60, the temperature detection unit 65, and the control unit 90. Then, the transporting belt 22 includes the support face 22*a* to which the medium M is adhered and which supports the medium M, and transports the medium M adhered thereto. The heating unit 50 heats the transporting belt 22 before the medium M is supported by the support face 22*a*. The pressing unit 60 is provided downstream of the heating unit 50 in the movement direction of the transporting belt 22, and presses the medium M against the support face 22*a*. The temperature detection unit 65 detects the temperature of the support face 22*a* from the heating unit 50 to the pressing unit 60, in the movement direction. The control unit 90 controls the heating unit 50 on the basis of the detection result from the temperature detection unit 65.

According to the above-described configuration, the heating unit 50 can be controlled on the basis of the temperature of the support face 22*a* from the heating unit 50 to the pressing unit 60, which contributes to the adhesiveness between the medium M and the transporting belt 22, and it is thus possible to stabilize the adhesiveness of the medium M with respect to the transporting belt 22 compared to a case in which the above-described configuration is not provided. Therefore, the transport device 1 that stabilizes the adhesiveness of the medium M with respect to the transporting belt 22 can be realized.

The transport device 1 according to the present embodiment is provided with the rollers (the driving roller 24 and the rotating roller 23) on which the transporting belt 22 is wound. Further, the heating unit 50 is provided with the plurality of heating portions 52 arranged in the movement direction of the transporting belt 22. Further, the control unit 90 selects, from among the plurality of heating portions 52, the heating portions 52 to be energized on the basis of the movement speed of the transporting belt 22 determined by the number of printing passes, and the detection result of the temperature of the adhesive layer 25.

Note that a heat accumulation amount of the transporting belt 22 heated by the heating unit 50 normally changes depending on the heating time period.

According to the above-described configuration, when the movement speed of the transporting belt 22 is slow (in the case of the low speed mode), of the plurality of heating portions 52, the number of heating portions 52 to be energized is reduced, compared to when the movement speed of the transporting belt 22 is fast (in the case of the high speed mode). Thus, the heat accumulation amount when the movement speed of the transporting belt 22 is slow and the heat accumulation amount when the movement speed of the transporting belt 22 is fast can be caused to be substantially the same.

Further, heat energy transferred from the transporting belt 22 to the rollers (the driving roller 24 and the rotating roller 23) when the movement speed of the transporting belt 22 is slow can also be caused to be substantially the same as heat energy transferred from the transporting belt 22 to the rollers when the movement speed of the transporting belt 22 is fast, and a degree of thermal expansion of the rollers is thus substantially the same at each of the speeds. Thus, the degree of thermal expansion of the rollers is made uniform at each of the speeds, and a transport accuracy resulting from the thermal expansion of the rollers is also made uniform. As a result, accuracy of transporting the medium M can be improved.

In the transport device 1 according to the present embodiment, in accordance with the movement speed, from among the plurality of heating portions 52, the control unit 90 selects the heating portions 52 in order from the heating unit 52 closest to the pressing unit 60, and heats the support face 22*a*. According to the above-described configuration, by selecting, from among the plurality of heating portions 52, the heating portion 52 closest to the pressing unit 60 and heating the support face 22*a*, the distance from the selected heating unit 52 to the pressing unit 60 can be shortened compared to a case in which the heating portion 52 furthest from the pressing unit 60 is selected, and heating loss that increases depending on the distance can be reduced.

In the transport device 1 according to the present embodiment, the control unit 90 adjusts the input to the heating unit 50 on the basis of the movement speed and the detection result in order to adjust the temperature of the heating unit 50.

According to the above-described configuration, the control unit 90 adjusts the input to the heating unit 50 (changes the output of the selected heating portions 52 while selecting the heating portions 52 to be heated) on the basis of the movement speed and the detection result in order to adjust the temperature of the heating unit 50. In this way, the temperature of the adhesive in the vicinity of the pressing unit 60 is even more appropriately adjusted, and the adhesiveness of the medium M with respect to the transporting belt 22 can be further stabilized.

The printing device 100 according to the present embodiment is provided with the transporting belt 22, the printing unit 30 as the recording unit, the heating unit 50, the pressing unit 60, the temperature detection unit 65, and the control unit 90. Then, the transporting belt 22 includes the support face 22*a* to which the medium M is adhered and which supports the medium M, and transports the medium M adhered thereto. The printing unit 30 performs recording on the medium M being transported. The heating unit 50 heats the transporting belt 22 before the medium M is supported by the support face 22*a*. The pressing unit 60 is provided downstream of the heating unit 50 in the movement direction of the transporting belt 22, and presses the medium M against the support face 22*a*. The temperature detection unit 65 detects the temperature of the support face 22*a* from the heating unit 50 to the pressing unit 60, in the movement direction. The control unit 90 controls the heating unit 50 on the basis of the detection result from the temperature detection unit 65.

According to the above-described configuration, the heating unit 50 can be controlled on the basis of the temperature of the support face 22*a* from the heating unit 50 to the pressing unit 60, which contributes to the adhesiveness between the medium M and the transporting belt 22. Therefore, the adhesiveness of the medium M with respect to the transporting belt 22 can be stabilized compared to a case in which the above-described configuration is not provided. Thus, the printing can be performed reliably, and the printing device 100 that improves the image quality can be realized.

In the printing device 100 according to the present embodiment, the heating unit 50 includes the plurality of heating portions 52 arranged in the movement direction. Then, from among the plurality of heating portions 52, the control unit 90 selects the heated portions 52 to be energized on the basis of the movement speed of the transporting belt 22 and the detection result.

According to the above-described configuration, by causing the cooling performance of the transporting belt 22 after reaching 65° C. to be close to that of graph A illustrated in FIG. 6, that is, by causing the amount of heat accumulated in the transporting belt 22 to be relatively small, the amount of heat (the temperature) of the transporting belt 22 when the portion of the transporting belt 22 heated by the heating portions 52 reaches the printed portion 30 is small. Here, the higher the temperature of the portion of the transporting belt 22 heated by the heating portions 52 after passing through the pressing unit 60, the more the temperature gradient increases in the positive Y direction after reaching the printing unit 30. This is because the surroundings of the printing unit 30 are exposed to the atmosphere, and heat is released into the atmosphere each time the transporting belt 22 moves in the positive Y direction. In the present embodiment, the amount of heat (the temperature) of the portion of the transporting belt 22 heated by the heating portions 52 when that portion reaches the printed portion 30 is small, and thus, the temperature gradient of the transporting belt 22 (the support face 22*a*) in the positive Y direction is reduced. In this way, the color differences in the positive Y direction of the image recorded on the medium M caused by the temperature gradient can be reduced. As a result, the quality of the image recorded on the medium M can be improved.

What is claimed is:

1. A transport device comprising:

a transporting belt including a support face that adhesively supports a medium, and configured to transport the adhered medium;

a heating unit configured to heat the transporting belt before the medium is supported at the support face;

a pressing unit provided downstream of the heating unit in a movement direction of the transporting belt, and configured to press the medium against the support face;

a temperature detection unit configured to detect a temperature of at least a part of the support face, from the heating unit to the pressing unit in the movement direction; and a control unit configured to control the heating unit based on a detection result of the temperature detection unit.

2. The transport device according to claim 1, comprising:

a roller on which the transporting belt is wound, wherein the heating unit includes a plurality of heating portions arranged in the movement direction, and the control unit selects, from among the plurality of heating portions, the heating portion to be energized based on a movement speed of the transporting belt and on the detection result.

3. The transport device according to claim 2, wherein in accordance with the movement speed, the control unit selects, from among the plurality of heating portions, the heating portion for heating the support face in order from the heating portion closest to the pressing unit.

4. The transport device according to claim 2, wherein the control unit adjusts a temperature of the heating unit by adjusting an input to the heating unit, based on the movement speed and on the detection result.

5. A recording device comprising:

a transporting belt including a support face that adhesively supports a medium, and configured to transport the adhered medium;

a recording unit configured to perform recording on the transported medium;

a heating unit configured to heat the transporting belt before the medium is supported at the support face;

a pressing unit provided downstream of the heating unit in a movement direction of the transporting belt, and configured to press the medium against the support face;

a temperature detection unit configured to detect a temperature of at least a part of the support face, from the heating unit to the pressing unit in the movement direction; and a control unit configured to control the heating unit based on a detection result of the temperature detection unit.

6. The recording device according to claim 5, wherein the heating unit includes a plurality of heating portions arranged in the movement direction; and the control unit selects, from among the plurality of heating portions, the heating portion to be energized based on a movement speed of the transporting belt and on the detection result.

* * * * *